United States Patent [19]

Mikulecky

[11] 4,146,862

[45] Mar. 27, 1979

[54] ENERGY LIMITING OIL IMMERSIBLE FUSE

[75] Inventor: Harvey W. Mikulecky, Waukesha, Wis.

[73] Assignee: RTE Corporation, Waukesha, Wis.

[21] Appl. No.: 828,430

[22] Filed: Aug. 29, 1977

[51] Int. Cl.[2] ..... H01H 85/02

[52] U.S. Cl. ..... 337/252; 337/158; 337/292

[58] Field of Search ..... 337/252, 251, 248, 205, 337/158, 292, 273, 274, 279; 29/623

[56] References Cited

U.S. PATENT DOCUMENTS

| | | | |
|---|---|---|---|
| 2,532,078 | 11/1950 | Baxter | 337/251 |
| 3,840,836 | 10/1974 | Link | 337/292 |

FOREIGN PATENT DOCUMENTS

| | | | |
|---|---|---|---|
| 1099059 | 2/1961 | Fed. Rep. of Germany | 337/248 |
| 601836 | 2/1960 | Italy | 337/248 |

*Primary Examiner*—Harold Broome
*Attorney, Agent, or Firm*—Ronald E. Barry

[57] ABSTRACT

An oil immersible current limiting full range fuse including a tubular housing, end caps hermetically sealed to each end of the housing and supporting a full range fuse assembly within said housing, the housing being filled with a granular arc extinguishing filler, the hermetic seal provided between the housing and the end caps is formed by a resilient gasket mounted at each end of the housing and epoxy adhesive provided in the end caps, the adhesive being displaced by the gasket on insertion into the space between the end cap and the outer wall of the housing.

A method for testing the hermetic seals for leaks which includes the steps of injecting sulfur hexafluoride into the housing, sealing the housing, confining the fuse in a closed space for a predetermined period of time and testing the atmosphere of the confined space to determine the presence of sulfur hexafluoride. The full range fuse assembly is provided with a pair of contacts at each end which are electrically connected to the end caps by induction heating after assembly. The tin element assembly of the full range fuse assembly is provided with a reinforcing glass roving sleeve.

13 Claims, 4 Drawing Figures

ENERGY LIMITING OIL IMMERSIBLE FUSE

BACKGROUND OF THE INVENTION

Full range fuses have been used for some time in transformer applications. However, these fuses generally could not be immersed in the transformer's oil. In order for the fuse to be immersible in oil, the oil seal provided by the end cap must maintain an absolute seal for the life of the fuse under oil (typically 20 years). This oil has an extreme temperature range of −30° C. to a maximum of 140° C.

SUMMARY OF INVENTION

The full range current limiting fuse of the present invention provides oil immersibility, fast low current clearing and easier coordination into the system. It is the first fuse that is both oil immersible and full range clearing. Because it is an oil immersible fuse and can, therefore, be mounted inside the transformer tank, the need for live front fusing installations with their bulky air bushings has been eliminated. Oil immersibility makes it possible to allow smaller clearances and shorter creep paths.

Oil immersibility is achieved through a unique double seal provided at each end of the fuse. The double seal is provided by a Buna N rubber gasket and a cured adhesive sealant that is pressed into place and shaped by the action of the rubber gasket on assembly. In this regard, the rubber gasket acts as a hydraulic plunger which is pushed into an annular groove in the end cap. Adhesive sealant in the groove is forced into the gap between the cap and the tubular housing.

Fuse integrity is assured by a simple test involving the detection of sulfur hexafluoride which has been injected into the fuse. This double seal system combined with the quality control procedure assures a fuse which is capable of unique applications and superior performance.

A unique assembling procedure is also provided which assures a permanent contact between the fuse element assembly and the fuse end caps. The fuse element assembly is also provided with an improved low current fault fuse which has been reinforced with a glass roving sleeve mounted on the silicone sleeve.

DRAWINGS

DESCRIPTION OF THE INVENTION

Figure 1:
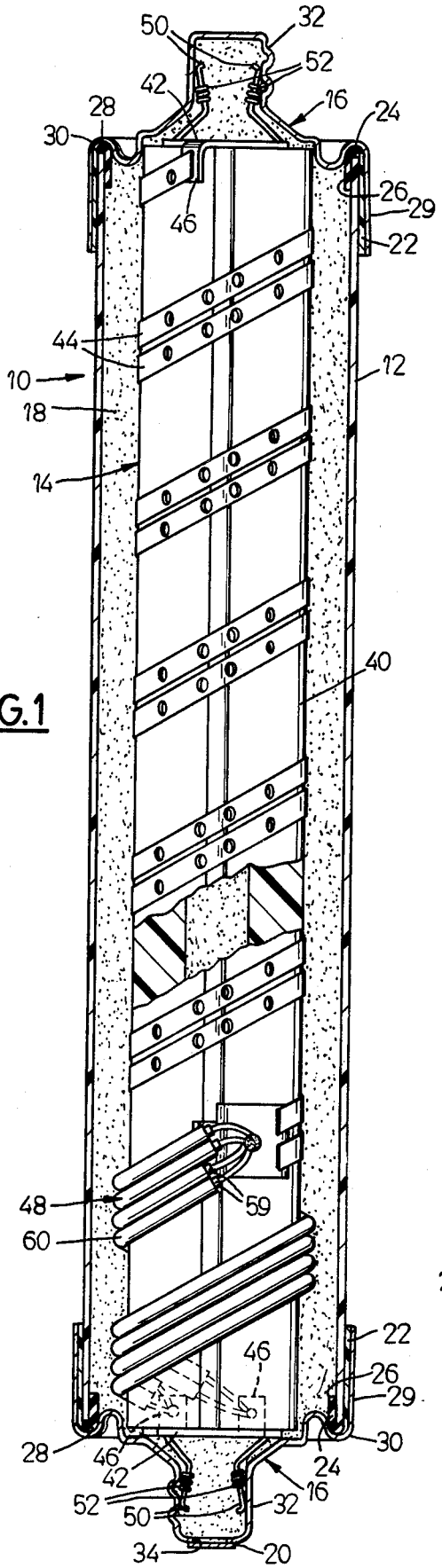
FIG. 1 is a sectional elevation view of the fuse according to the present invention.

The oil immersible full range fuse 10 of the present invention generally includes a glass reinforced tube or housing 12, a fuse element assembly 14 supported within the housing by means of a pair of end caps 16. The housing 12 is filled with a granular arc extinguishing filler 18 and is closed at the end by means of a fill cap 20 soldered to the end cap 16. As more particularly described hereinafter, the fuse 10 is sealed by a unique seal provided between the end cap 16 and the glass reinforced tubing 12.

In this regard it should be noted that the end caps 16 are made of copper and the housing 12 is formed from glass reinforced material. In order to obtain an adequate seal between the end caps and the tubing, an epoxy adhesive sealant 22 was determined to be the best sealant for these materials. However, it was difficult to apply the sealant in such a way that it would substantially completely fill the space between the end caps and the tubing. This was achieved by providing a rubber gasket 24 on each end of the glass reinforced tubing 12 which acts as a hydraulic piston to displace the adhesive.

The rubber gasket 24 includes a tapered cylindrical section 26 and a lip or flange 28. The tapered section 26 has an outer diameter slightly larger than the inside diameter of the tubing 12. The gasket is inserted into the tubing 12 until the lip or flange 28 abuts the end of the tubing. The cylindrical section forms an interference fit with the tubing and the flange 28 extends slightly beyond this end of the tubing.

Figure 2:
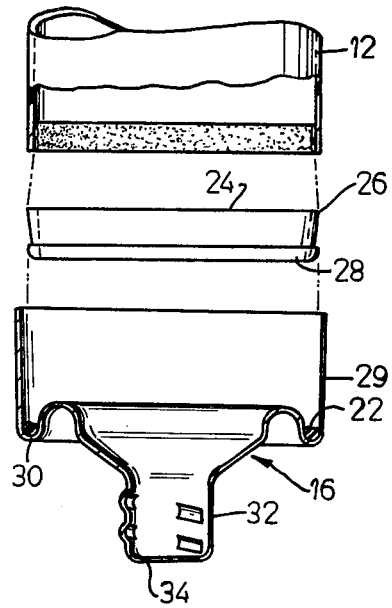
FIG. 2 is an exploded sectional of one end of the fuse.

Referring to FIG. 2, it will be noted that the end cap 16 is provided with a cylindrical section 29 which terminates at an annular groove or recess 30. A threaded end section 32 is provided at the end of its cap and a filler hole 34 can be provided in the end of the section 32.

Figure 3:
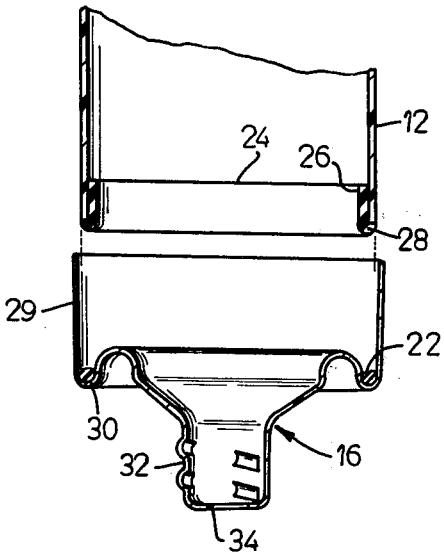
FIG. 3 is similar to FIG. 2 showing the gasket in position on the end of the fuse housing and the adhesive in the groove of the end cap.

As seen in FIG. 3, on assembly the gasket 24 is inserted into the tube 12 until the lip 28 is seated against the end of the tube 12. A predetermined amount of the epoxy sealant material 22 is then injected into the groove 30. Entrapped air in the adhesive is removed by a controlled vacuum evacuation process.

Figure 4:
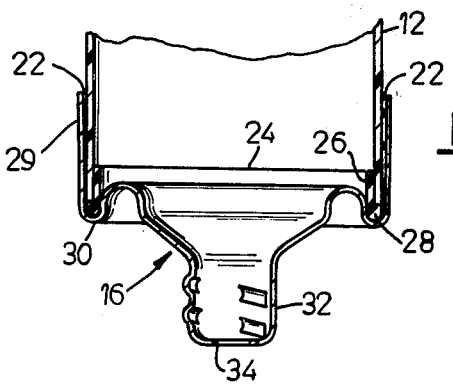
FIG. 4 is a view similar to FIG. 3 showing the end cap assembled on the fuse housing.

The epoxy sealant 22 is forced into the space between the tube and the end cap 16 by inserting the rubber gasket 24 into the annular groove 30 as seen in FIG. 4. The lip 28 of the rubber gasket acts as a piston forcing the sealant out of the recess 30 upwardly into the gap between the tube 12 and the end cap 16. It should be noted that the rubber gasket 24 has an inside diameter slightly smaller than the inside diameter of the annular groove 30 so that it slides down the inside surface of the annular groove into the recess 30. The outer diameter of the lip 28 is slightly smaller than the inside diameter of the cylindrical section 29 of the end cap to allow the adhesive sealant 22 to rise into the space between the end cap 16 and the tubing 12. A continuous slow displacement of the cap 16 from the surface of the tube 12 at 90° to the fuse axis is provided to assure exposure of all contacting surfaces of the cap and tube to the adhesive sealant. When the sealant reaches the top of the cylindrical section 29, the tube and end cap are placed in an oven at 100° C. for 1½ hours to cure the epoxy material.

After the sealant has set, the fuse assembly 14 is positioned in the tube in alignment with the end section 32, a gasket 24 is placed at the other end of the tube and a bead of sealant 22 is placed in the annular groove 30 in the other end cap 14. The assembly process as described above is repeated to force the sealant into the space between the tube and the end cap 14. It should be noted that the fuse assembly 14 is aligned with the end section 32 when the tube is pushed into the end cap. The sealant is then heated to cure the sealant. The fuse is completed by filling the tube 12 with grannular filler 18 such as fine silica sand through the fill opening 34 provided in one of the end caps. The fill opening is closed by soldering a fill cap 20 to cap 14.

The fuse assembly 14 has also been improved to reduce assembly time and to increase the strength of the full range fuse element. In this regard it should be noted that the fuse assembly 14 includes a spider 40, a terminal element 42 on each end of the spider, a pair of fuse ribbons 44 spirally wrapped around the spider and connected to a tab 46 on one of the terminal elements. The other end of the fuse ribbon is connected to the tab 46 on the other terminal element 42 by means of a tin element assembly 48. The terminal element 42 includes a pair of contact fingers 50 which are arranged to engage the inside surface of the end section 32.

In accordance with one aspect of the invention, means are provided for securing the contact fingers 50 to the caps 32. Such means is in the form of a number of turns of solder 52 provided on each of the contact fingers 50, the solder including flux to allow for induction heating of the solder through the end cap 16 in order to solder the contact fingers 50 to the end cap 16.

The tin element assembly 48 is substantially described in U.S. Pat. No. 3,840,836, entitled "Current Limiting Sand Fuse" issued on Oct. 8, 1974.

As described in that patent, the tin element assembly 48 includes a tin element enclosed within a silicone rubber tubing 59. In accordance with the present invention, a glass roving sleeve 60 is placed over the silicone rubber tubing 59 in order to increase the strength of the silicone rubber tube. It should be understood that the silicone rubber tube is subjected to very high internal pressure when operating at high current (several hundred amperes). The glass roving thus reinforces the rubber tubing and since it is completely inorganic, it prevents any carbon build up in the event that some hot gases escape from the silicone tube.

The sealed fuse 10 of the present invention is tested for leaks by a method considered unique in this application. After filling the fuse with the sand filler, the fuse is back filled with a small quantity of sulfur hexafluoride ($SF_6$) gas. The fuse is then closed by soldering the fill cap 20 to the end section 32 to close the fill opening 34 and seal the fuse. The assembled fuse is then placed in a closed container for a predetermined period of time, i.e. 30 minutes minimum, and the container then tested for the presence of sulfur hexafluoride. If sulfur hexafluoride is detected, the fuse is rejected.

The embodiments of the invention in which an exclusive property or privilege is claimed are defined as follows:

1. An oil immersible current limiting fuse comprising a housing, an end cap mounted on each end of said housing, a fuse assembly supported by said caps within said housing, a granular arc extinguishing filler completely filling said housing and means for hermetically sealing said caps to said housing, said means including a resilient gasket mounted at each end of said housing and an epoxy adhesive in said end caps whereby said adhesive is displaced by said gaskets on assembly to fill the space between the end caps and the housing.

2. The fuse according to claim 1 wherein said housing is in the form of a hollow tube and said end caps include a cylindrical section having an inner diameter greater than the outer diameter of said tube.

3. The fuse according to claim 1 wherein said caps include an end section and said fuse assembly includes means at each end for electrically connecting said assembly to said end sections.

4. A fuse according to claim 3 wherein said connecting means is heat actuated.

5. The fuse according to claim 3 wherein said connecting means includes a pair of fingers at each end of said assembly and a number of turns of solder on each of said fingers whereby on application of heat to said end cap said solder is fused to said end cap.

6. A sealed full range current limiting fuse comprising a hollow glass fiber tube having an opening at each end, a resilient gasket mounted on each end of said tube, a dual element full range fuse assembly positioned in said tube, an electrically conductive end cap mounted on each end of said tube and supporting said fuse assembly in a spaced relation to said tube, each end cap including an annular groove, a sealant in each of said grooves, said sealant being displaced into the space between the end cap and the outer wall of the housing when the gasket is seated in said groove, and a granular arc-extinguishing filler completely filling said housing.

7. The fuse according to claim 6 wherein said end caps include a cylindrical section having an inner dimension greater than the outer dimension of said tube, said cylindrical section terminating at said groove whereby said gasket will be seated in said groove on assembly on said tube.

8. The fuse according to claim 6 wherein said end caps include an end section and said fuse assembly includes means at each end for electrically connecting said assembly to said end caps.

9. The fuse according to claim 8 wherein said connecting means is heat actuated.

10. The fuse according to claim 8 wherein said assembly includes a pair of fingers at each end of said assembly and a number of turns of solder on each of said fingers and electrically connecting said fingers to said end sections.

11. A fuse assembly for a current limiting fuse, said assembly including a first fusible element of high current clearing characteristics and a second fusible element of low current clearing characteristics, said first and second elements being connected in a series, arc extinguishing member enclosing the full length of said second fusible element and a reinforcing sleeve enclosing said arc extinguishing sleeve.

12. The assembly according to claim 11 wherein said reinforcing sleeve is formed by glass roving material.

13. The assembly according to claim 12 including a connecting finger at each end of said first and second elements and a member of turns of solder on each of said fingers.

* * * * *

UNITED STATES PATENT OFFICE

CERTIFICATE OF CORRECTION

Patent No. 4,146,862 Dated 3/27/79

Inventor(s) Harvey W. Mikulecky

It is certified that error appears in the above-identified patent and that said Letters Patent are hereby corrected as shown below:

Column 4, Line 58, delete "member" and substitute ---number---;

Signed and Sealed this

*Twenty-fifth* Day of *September 1979*

[SEAL]

*Attest:*

*Attesting Officer*

LUTRELLE F. PARKER

*Acting Commissioner of Patents and Trademarks*